US007299598B2

(12) United States Patent
Gembala et al.

(10) Patent No.: US 7,299,598 B2
(45) Date of Patent: Nov. 27, 2007

(54) FASTENER FOR LIGHTWEIGHT CONCRETE ROOF SYSTEMS

(76) Inventors: Henry Gembala, 1431 SW. 30th Ave., Deerfield Beach, FL (US) 33442; David Gembala, 1431 SW. 30th Ave., Deerfield Beach, FL (US) 33442; Tom Steier, 1431 SW. 30th Ave., Deerfield Beach, FL (US) 33442

( * ) Notice: Subject to any disclaimer, the term of this patent is extended or adjusted under 35 U.S.C. 154(b) by 611 days.

(21) Appl. No.: 10/836,523

(22) Filed: Apr. 30, 2004

(65) Prior Publication Data

US 2004/0216405 A1 Nov. 4, 2004

Related U.S. Application Data

(60) Provisional application No. 60/467,202, filed on May 1, 2003.

(51) Int. Cl.

| | |
|---|---|
| ***E04B 1/38*** | (2006.01) |
| ***E04B 9/00*** | (2006.01) |
| ***E04C 5/00*** | (2006.01) |
| ***E04F 13/04*** | (2006.01) |

(52) U.S. Cl. ..... 52/713; 52/712; 52/353; 52/357

(58) Field of Classification Search ..... 52/783.17, 52/414, 677, 712, 713, 719, 351, 353, 358, 52/410, 326, 684, 455, 357
See application file for complete search history.

(56) References Cited

U.S. PATENT DOCUMENTS 982,210 A * 1/1911 Johnson ..... 52/378
1,340,291 A * 5/1920 Pratt ..... 52/334
1,479,966 A * 1/1924 Oran ..... 52/370
1,897,327 A * 2/1933 Olson ..... 52/410
1,946,418 A * 2/1934 Welch ..... 52/684
2,104,876 A * 1/1938 Wetherbee ..... 52/293.3
3,299,593 A * 1/1967 Avila ..... 52/219
3,426,494 A * 2/1969 Hala ..... 52/410
4,120,131 A * 10/1978 Carroll ..... 52/310
4,685,264 A * 8/1987 Landis ..... 52/252
4,819,401 A * 4/1989 Whitney, Jr. ..... 52/713
5,392,581 A * 2/1995 Hatzinikolas et al. ..... 52/712
5,415,511 A * 5/1995 Damron ..... 411/480
5,451,120 A * 9/1995 Martinez-Gonzalez ..... 405/262
5,634,310 A * 6/1997 Hohmann ..... 52/513
6,508,040 B2 * 1/2003 Nelson ..... 52/514
6,837,013 B2 * 1/2005 Foderberg et al. ..... 52/356

* cited by examiner

*Primary Examiner*—Robert Canfield
*Assistant Examiner*—Hunter M Dreidame
(74) *Attorney, Agent, or Firm*—Robert M. Downey, PA

(57) ABSTRACT

A device for use in the installation of lightweight concrete roof systems includes a base element having a substantially flat portion and a wire tie. The wire tie extends from the base element and terminates at opposite ends which may be formed in a ring or loop. In use, the base element is mechanically fastened to the bar joist, through the steel deck, of the roof system. The terminal ends of the wire tie are secured to steel-welded wire reinforcement fabric overlying a layer of lightweight concrete, thereby securing the lightweight concrete to the steel deck of the roof system and preventing separation of the lightweight concrete due to external forces such as wind sheer.

10 Claims, 2 Drawing Sheets

FASTENER FOR LIGHTWEIGHT CONCRETE ROOF SYSTEMS

This Application is based on Provisional Patent Application Ser. No. 60/467,202 filed on May 1, 2003.

BACKGROUND OF THE INVENTION

1. Field of the Invention

The present invention relates to a device for use in the installation of lightweight concrete roof systems and, more particularly, to a device for securing lightweight concrete to an underlying steel deck of a roof system, thereby preventing separation of the lightweight concrete from the underlying roof structure when subjected to external forces, such as wind sheer.

2. Discussion of the Related Art

Certain roof systems, such as those typically found in the construction of a commercial building, involve the installation of a steel deck over a bar joist. The steel deck is attached to the underlying bar joist by direct welding, welding with washers, or the use of mechanical fasteners such as TEK screws. Once the steel deck is properly attached to the underlying bar joist, the top of the steel deck is prepared and a layer of lightweight concrete is installed on top of the deck. In many instances, expanded polystyrene (EPS) insulation boards or panels are installed in the slurry of lightweight concrete. The lightweight concrete and EPS board provide a desired slope for drainage and add insulation R-value to the building.

Presently, the failure of lightweight concrete roof systems is often a result of separation of the lightweight concrete layer from the steel deck caused by wind sheer and flexing of the underlying steel deck. When the steel deck is caused to flex, separation often occurs between the steel deck and the lightweight concrete. Separation also occurs between the lightweight concrete and the EPS board.

Presently, the A.R.B.S. System, as disclosed in U.S. Pat. Nos. 6,237,293B1 and 6,421,971B1 to Gembala is the most effective means used in the construction industry for securing lightweight concrete to the underlying deck structure of a roof system in order to prevent subsequent separation and sheering of the lightweight concrete from the deck. The fastening device of the present invention is most effective when used in conjunction with the A.R.B.S. System. However, the fastening device may be used with other conventional roof blocking methods, such as wood blocking.

SUMMARY OF THE INVENTION

The present invention is directed to a fastening device for use in the installation of lightweight concrete roof systems.

The fastening device includes a base element having a substantially flat portion with a top side and a bottom side. A wire tie is secured to the base element so that two legs of the wire tie extend from the base element and terminate at free distal ends. In a preferred embodiment, the free distal ends of the wire tie are formed in a ring or loop.

In use, the base element of the fastening device is mechanically fastened to the bar joist of the roof system, through the steel deck. After application of a slurry of lightweight concrete over the top of the steel deck, a steel welded wire reinforcement fabric is laid on the top of the lightweight concrete layer. The terminal distal ends of the fastening device are secured to the steel welded wire reinforcement fabric to effectively hold the lightweight concrete layer sandwiched between the steel welded wire reinforcement fabric and the steel deck.

BRIEF DESCRIPTION OF THE DRAWINGS

For a fuller understanding of the nature of the present invention, reference should be made to the following detailed description taken in conjunction with the accompanying drawings in which.

Like reference numerals refer to like parts throughout the several views of the drawings.

DETAILED DESCRIPTION OF THE PREFERRED EMBODIMENT

Figure 1:
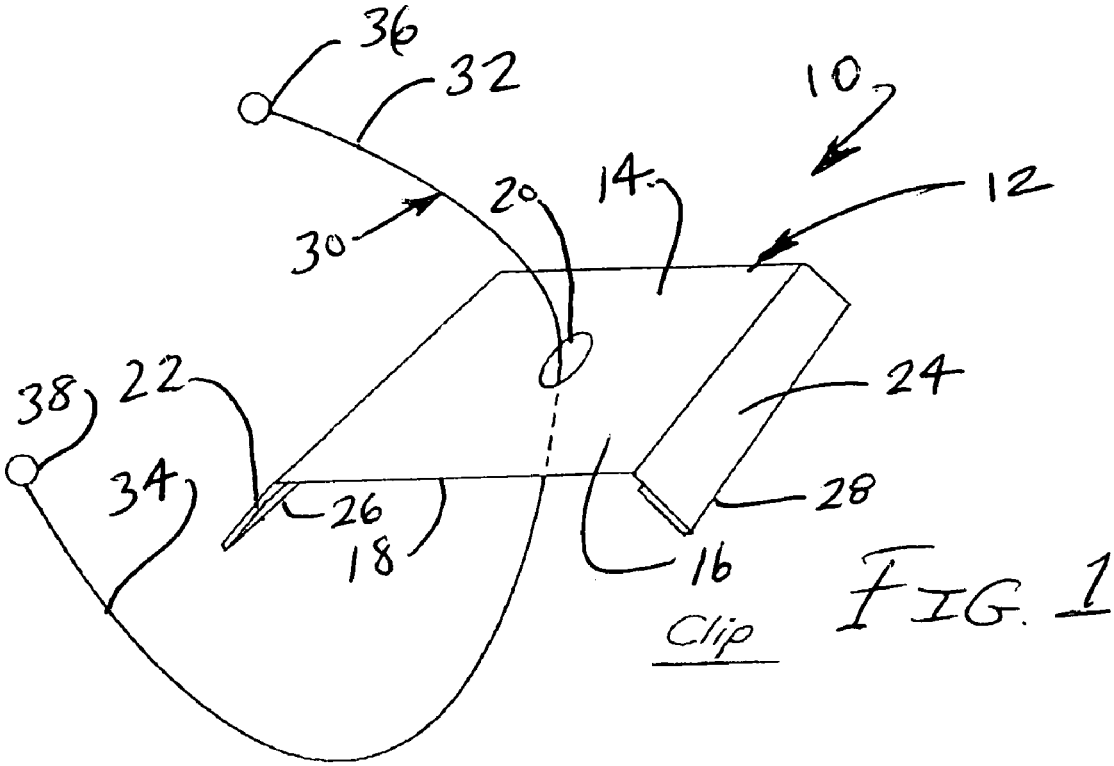
FIG. 1 is a top perspective view of the fastening device of the present invention in accordance with one embodiment thereof.
Figure 2:
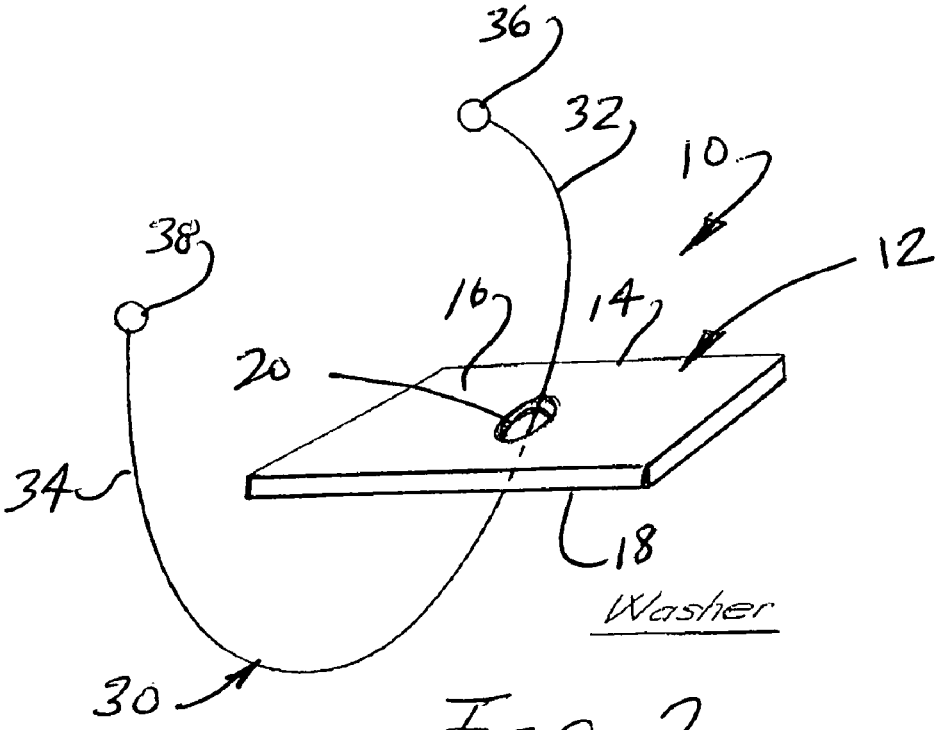
FIG. 2 is a top perspective view of the fastening device of the present invention in accordance with another preferred embodiment thereof.

Referring initially to FIGS. 1 and 2, the fastening device of the present invention is shown in accordance with several embodiments and is generally indicated as 10. In each embodiment, the fastening device 10 includes a base element 12 having a substantially flat portion 14 with a top side 16 and a bottom side 18. An hole 20 may be formed through the flat portion 14 to accommodate passage of a mechanical fastener, such as a TEK screw, for fastening the base element 12 to the deck structure of the roof system. In each of the embodiments of FIGS. 1 and 2, the fastening device 10 further includes a wire tie 30. The wire tie 30 is preferably welded or otherwise secured to the base element 12 and includes opposite leg portions 32, 34 extending upwardly from the base element 12 and terminating at respective distal ends 36, 38. In a preferred embodiment, the distal ends 36, 38 are formed in a ring or loop for grasping and securing the leg portions 32, 34 to a steel welded wire reinforcement fabric, as described hereinafter.

The base element 12 in the embodiment of FIG. 1 is in the form of a deck clip for attachment to the steel deck of the roof system. In the preferred embodiment, the deck clip is formed of 16-gauge galvanized steel and includes downwardly angled wings 22, 24. Each wing has a bottom edge 26, 28 which engages the top surface of the roof deck structure 50. A fastener, such as a TEK screw, passes through the the hole 20 and into the deck structure 50 to secure the base element 12 to the deck structure 50.

In the embodiment of FIG. 2, the base element 12 is in the form of a square or round welding washer which is substantially flat, as shown. Similar to the embodiment of FIG. 1, the welding washer may be formed of 16-gauge galvanized steel and is secured to the deck structure 50 by welding or with the use of a mechanical fastener, such as a TEK screw.

Figure 3:
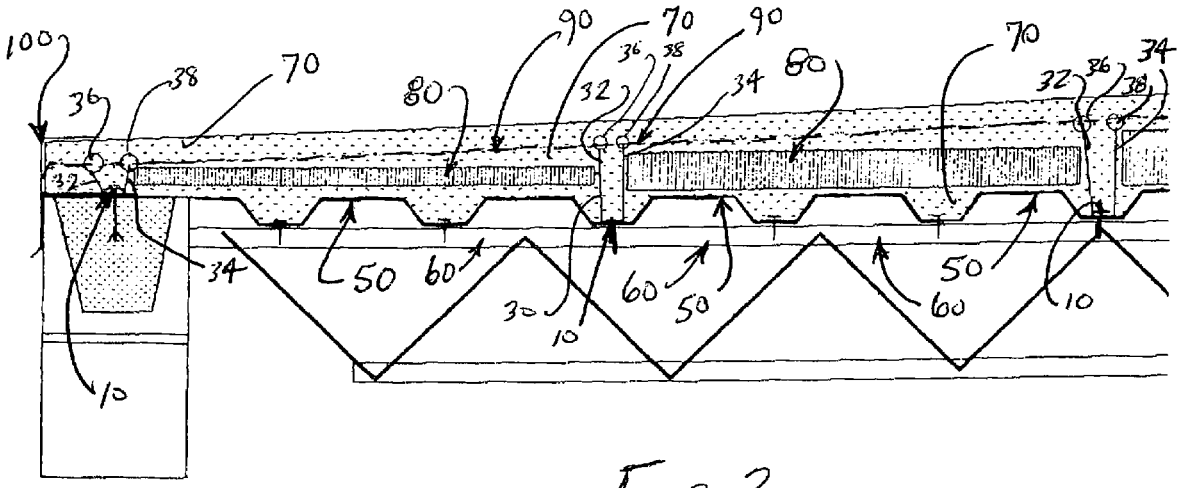
FIG. 3 is a side elevation, in cross section, illustrating the fastening device installed in a typical lightweight concrete roof system.

FIG. 3 shows a typical roof structure incorporating a lightweight concrete roof system. As shown, a steel deck 50 is installed over a bar joist 60. In a preferred embodiment, the steel deck is secured to the underlying bar joist with the use of mechanical fasteners, such as TEK screws. Alternatively, the steel deck may be secured with welding washers. At this stage, the fastening device 10 of the present invention is secured to the steel deck and welded or mechanically fastened to the steel deck and underlying bar joist. The opposite leg portions 32, 34 of the wire tie 30 are pulled upwardly and a slurry lightweight concrete 70 is poured onto the prepared steel deck 50. Expanded polystyrene (EPS) board 80 is installed in the slurry of lightweight concrete. Thereafter, a steel welded wire reinforcement fabric is laid on top of the lightweight concrete 70, above the EPS board. The distal ends 36, 38 of the wire tie 30 are secured to the steel welded reinforcement fabric 90. Additional lightweight concrete 70 may be then applied over the steel welded wire reinforcement fabric 90. With the ends 36, 38 of the wire tie 30 physically secured to the steel welded wire reinforcement fabric 90, the lightweight concrete 70 is held in sandwiched relation between the steel welded wire reinforcement fabric 90 and the underlying steel deck 50. At the perimeter of the roof, the welded wire reinforcement fabric 90 can be mechanically fastened to the edge enclosure blocking structure 100. The edge enclosures of U.S. Pat. Nos. 6,237,293B1 and 6,421,971B1 to Gembala are ideally suited for use in conjunction with the reinforcement fabric 90 and fastening device 10 of the present invention.

While the instant invention has been shown and described in accordance with preferred and practical embodiments thereof, it is recognized that departures from the instant disclosure are contemplated within the spirit and scope of the present invention.

What is claimed is:

1. A device for securing a layer of lightweight concrete to an underlying deck structure of a roof system, wherein the layer of lightweight concrete includes a reinforcement material, said device comprising:

a base element having a top side and a bottom side, said base element being structured and disposed for fixed attachment to the deck structure, and said base element including downwardly angled wings each having a bottom edge for engaging the deck structure; and a wire tie attached to said base element and including opposite leg portions extending from said base portion and terminating at respective distal ends, said respective distal ends being structured and disposed for attachment to the reinforcement material so that said opposite leg portions are pulled taut between said base element and the reinforced material.

2. The device as recited in claim 1 wherein said base element includes a hole formed therethrough for passage of a mechanical fastener used to secure said base element to the deck structure.

3. The device as recited in claim 1 wherein said distal ends of said leg portions of said wire are in the form of a loop.

4. The device as recited in claim 3 wherein said base element includes a hole formed therethrough for passage of a mechanical fastener used to secure said base element to the deck structure.

5. A fastening system for securing a layer of lightweight concrete to an underlying deck structure of a roof system, said fastening system comprising:

a reinforcement fabric within the layer of lightweight concrete;

at least one fastening device comprising:

a base element, including a top side and a bottom side, and said base element being structured and disposed for attachment to the roof deck structure;

a wire tie attached to said base element and including opposite leg portions extending upwardly from said base element and terminating at respective distal ends, said respective distal ends being structured and disposed for attachment to said reinforcement fabric so that said opposite leg portions are pulled taut between said base element and said reinforcement fabric.

6. The system as recited in claim 5 wherein said base element includes a hole formed therethrough for passage of a mechanical fastener used to secure said base element to the deck structure.

7. The system as recited in claim 5 wherein said base element includes downwardly angled wings each having a bottom edge for engaging the deck structure of the roof system.

8. The system as recited in claim 5 wherein said distal ends of said leg portions of said wire tie are in the form of a loop.

9. The system as recited in claim 5 wherein said base element is attached to the deck structure by welding.

10. The system as recited in claim 5 further comprising:

a plurality of said fastening devices.

* * * * *